US005456790A

United States Patent [19]

Yu Chen

[11] Patent Number: 5,456,790

[45] Date of Patent: Oct. 10, 1995

[54] TAPE DISPENSER WITH A BLADE PROTECTOR

[75] Inventor: Hsiu-Man Yu Chen, Taichung Hsien, Taiwan

[73] Assignee: Yang Bey Industrial Co., Ltd., Taichung Hsien, Taiwan

[21] Appl. No.: 288,935

[22] Filed: Aug. 10, 1994

[51] Int. Cl.[6] ..... B44C 7/00

[52] U.S. Cl. ..... 156/527; 156/579; 156/577; 225/19; 225/20; 403/113; 403/117; 16/342

[58] Field of Search ..... 156/577, 579, 156/576, 574, 71, 527; 30/151, 286; 225/19, 20; 403/112, 113, 117; 16/337, 342

[56] References Cited

U.S. PATENT DOCUMENTS

| | | | |
|---|---|---|---|
| 3,828,395 | 8/1974 | Grady | 16/342 |
| 4,227,283 | 10/1980 | Mathewson et al. | 16/337 X |
| 4,762,586 | 8/1988 | Wilkie . | |
| 4,818,329 | 4/1989 | Tutas et al. | 156/577 X |
| 5,022,576 | 6/1991 | Jenq . | |
| 5,024,362 | 6/1991 | Karlsson . | |
| 5,110,401 | 5/1992 | Huang . | |
| 5,236,540 | 8/1993 | Shi . | |
| 5,269,871 | 12/1993 | Longworth et al. | 156/577 X |
| 5,382,108 | 1/1995 | Ojima | 403/113 X |
| 5,393,367 | 2/1995 | Yu Chen | 156/579 X |

*Primary Examiner*—David A. Simmons
*Assistant Examiner*—Steven J. Helmer
*Attorney, Agent, or Firm*—Bliss McGlynn

[57] ABSTRACT

The tape dispenser has a cutting device with a blade, a blade protecting shield mounted above the blade, and a pair of pivot shafts. The blade protecting shield has a frontward edge, a rearward edge opposite to the frontward edge, a projection with two opposed end portions which extend integrally and rearwardly from the rearward edge, and a pair of spaced pivot blocks which extend rearwardly from the rearward edge and which are respectively on two sides of the projection such that a clearance is formed between each of the pivot blocks and a respective one of the opposed end portions of the projection. Each of the pivot blocks has a recess to receive a respective one of the pivot shafts and is pivotable relative to the connecting plates between a first position, wherein the front edge of the blade protecting shield uncovers the blade, and a second position, wherein the blade protecting shield covers the blade.

3 Claims, 5 Drawing Sheets

TAPE DISPENSER WITH A BLADE PROTECTOR

BACKGROUND OF THE INVENTION

1. Field of the Invention

The invention relates to a tape dispenser, more particularly to a tape dispenser which has a cutting device that is provided with a blade protecting shield.

2. Description of the Related Art

A tape dispenser comprises generally a tape storage station and a tape dispensing portion which is spaced from the tape storage station. Referring to FIGS. 1 and 2, a conventional portable tape dispenser is shown to comprise a mounting frame 10 which includes a pair of spaced side plates 111 and a base plate 112 which extends between the side plates 111. The mounting frame 10 has a tape storage station formed at a first end portion thereof and a tape dispensing port at a second end portion thereof. A roll 101 of packing tape 15 is mounted detachably and rotatably at the tape storage station. A positioning roller 102 is mounted at the tape dispensing port for guiding the packing tape 15 out of the tape dispensing port and for pressing the packing tape 15 on the surface of an object. A cutting device 12 is mounted between the spaced side plates 111 of the mounting frame 10 adjacent to the positioning roller 102. The cutting device 12 includes a blade holding seat 120 fixed securely to the spaced side plates 111, a cutter blade 122 provided on the blade holding seat 120 and an L-shaped smoothing plate 123 which has a base portion 124 mounted detachably on the blade holding seat 120 so as to sandwich the cutter blade 122 securely between the base portion 124 of the L-shaped smoothing plate 123 and the blade holding seat 120. An L-shaped static adhesion plate 121 extends from the blade holding seat 120. A blade protecting shield 14 is hinged to a shaft 141 which is secured to the L-shaped smoothing plate 123 such that the blade protecting shield 14 dangles downward due to its weight so as to cover a cutting edge of the cutter blade 122 when the tape dispensing port is oriented downwardly. The positioning roller 102 serves to press the adhered portion of the packing tape 15 against the desired surface.

In use, a distal end portion of the packing tape 15 is pulled out from the tape dispensing port and is trained over the positioning roller 102. The distal end portion of the packing tape 15 is pressed on the desired surface by the positioning roller 102, thereby adhering the packing tape 15 on the desired surface, as shown in FIG. 2. Under this condition, the blade protecting shield 14 is lifted by tension of the packing tape 15 so that the cutting edge of the cutter blade 122 is exposed and is disposed adjacent to an extending route of the packing tape 15. The adhered portion of the packing tape 15 can be cut off by pressing the cutting edge of the cutter blade 122 toward the extending route of the packing tape 15. The static adhesion plate 121 serves to adhere the distal end of the unused portion of the roll 101 of packing tape 15 thereon. An appropriate amount of force must be applied in order to enable the smoothing plate 123 to smoothen the cut strip of the packing tape 15 on the desired surface.

A main drawback of the conventional tape dispenser is that the protecting shield 14 covers the cutting edge of the blade 122 only when the tape dispensing port is disposed downwardly. When the tape dispensing port is disposed upwardly, the cutting edge of the blade 122 is not covered by the protecting shield 14. Therefore, injury to an operator is likely to occur. In addition, the protecting shield must be manually lifted during use in order to permit a distal end portion of the packing tape 15 to be pressed on the desired surface. This inconveniences the operator and prolongs the packing period.

SUMMARY OF THE INVENTION

A main object of the present invention is to provide a tape dispenser which has a cutting device with a blade protecting shield that is capable of covering a cutting edge of a cutting device when not in use so that the likelihood of being injured by the cutting edge of the cutting device is eliminated.

Accordingly, a tape dispenser of the present invention includes a cutting device mounted adjacent to a tape dispensing port thereof for cutting a strip of tape from a tape end portion which is pulled out from the tape dispensing port along a tape dispensing route. The cutting device includes a blade holding seat, a blade and a smoothing unit. The blade holding seat has a front edge and a rear edge opposite to the front edge and is mounted fixedly adjacent to the tape dispensing port such that the front edge is nearby and transverse to the tape dispensing route and the rear edge is spaced from the tape dispensing route. The blade has a front portion with a cutting edge and is provided on the blade holding seat such that the cutting edge protrudes out of the front edge of the blade holding seat so as to extend into the tape dispensing route. The smoothing unit includes a base plate which has a rear periphery and which is mounted above the blade holding seat to sandwich a rear portion of the blade therebetween. The smoothing unit permits the cutting edge of the blade to protrude exteriorly from between the base plate and the blade holding seat. The smoothing unit further includes a smoothing plate which extends from the rear periphery of the base plate. The cutting device further comprises a pair of spaced connecting plates formed between the base plate and the smoothing plate and a pair of aligned pivot shafts which extend respectively and inwardly from the connecting plates. A blade protecting shield has a frontward edge, a rearward edge opposite to the frontward edge, a projection with two opposed end portions which extend integrally and rearwardly from the rearward edge, and a pair of spaced pivot blocks which extend rearwardly from the rearward edge and which are disposed respectively on two sides of the projection such that a clearance is formed between each of the pivot blocks and a respective one of the opposed end portions of the projection. Each of the pivot blocks has a recess for receiving a respective one of the pivot shafts and is pivotable relative to the connecting plates between a first position, wherein the projection of the blade protecting shield engages frictionally the base plate of the smoothing unit while the front edge of the blade protecting shield uncovers the cutting edge of the blade, and a second position, wherein the projection of the blade protecting shield engages frictionally the smoothing plate of the smoothing unit while the front edge of the blade protecting shield covers the cutting edge of the blade.

Each of the pivot blocks is further provided with an inclined face so that the pivot shafts of the blade protecting shield slide past the inclined faces and extend into the recesses of the pivot blocks when the blade protecting shield is pressed on the pivot shafts so as to mount the blade protecting shield.

Since the blade protecting shield is normally at the second position, the cutting edge of the blade is protected by the protecting shield so that the likelihood of being injured by the cutting device employed in the present invention is minimized. When it is desired to use the packing tape, a mere upward lift on the protecting shield can dispose the same at the first position, thereby exposing the cutting edge of the blade. Thus, it is more convenient to use the tape dispenser of the present invention when compared to the conventional tape dispenser described beforehand.

BRIEF DESCRIPTION OF THE DRAWINGS

Other features and advantages of the present invention will become more apparent in the following detailed description of the preferred embodiment, with reference to the accompanying drawings, in which.

DETAILED DESCRIPTION OF THE PREFERRED EMBODIMENT

Figure 1:
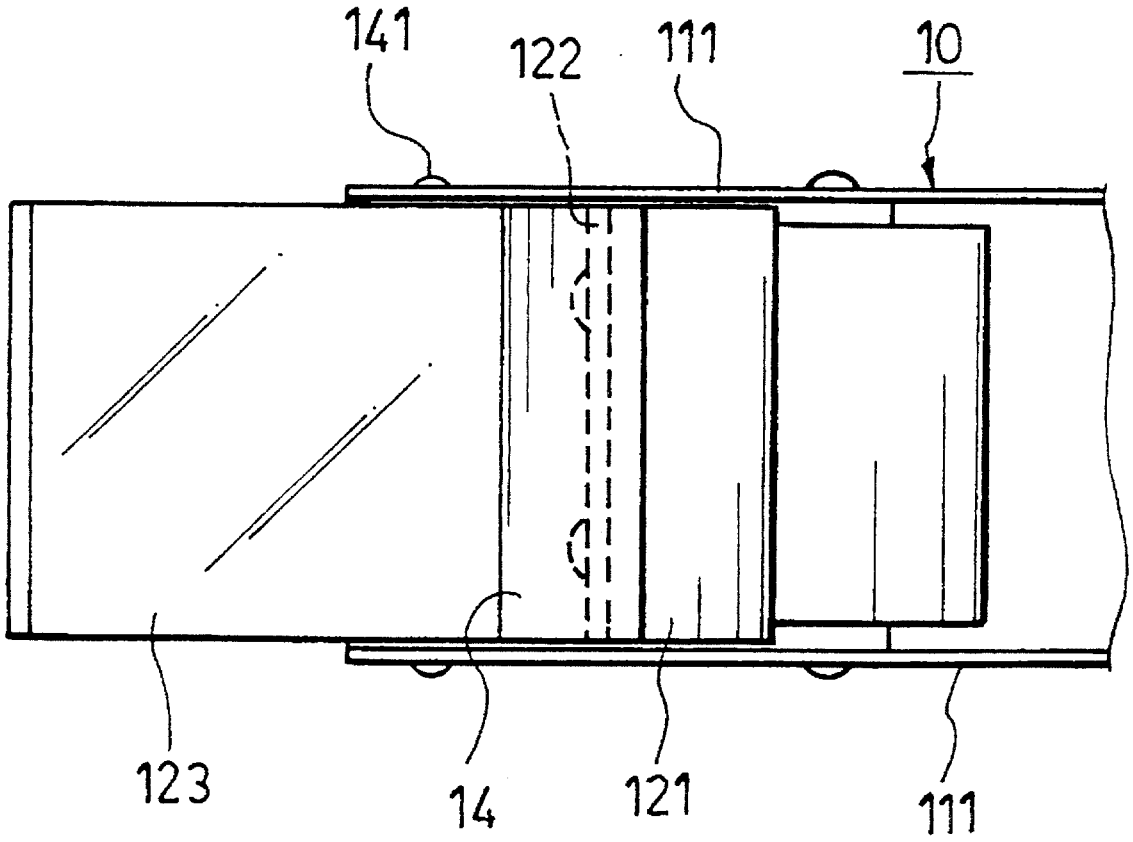
FIG.1 PRIOR ART
FIG. 1 is a top view of a conventional tape dispenser.
Figure 2:
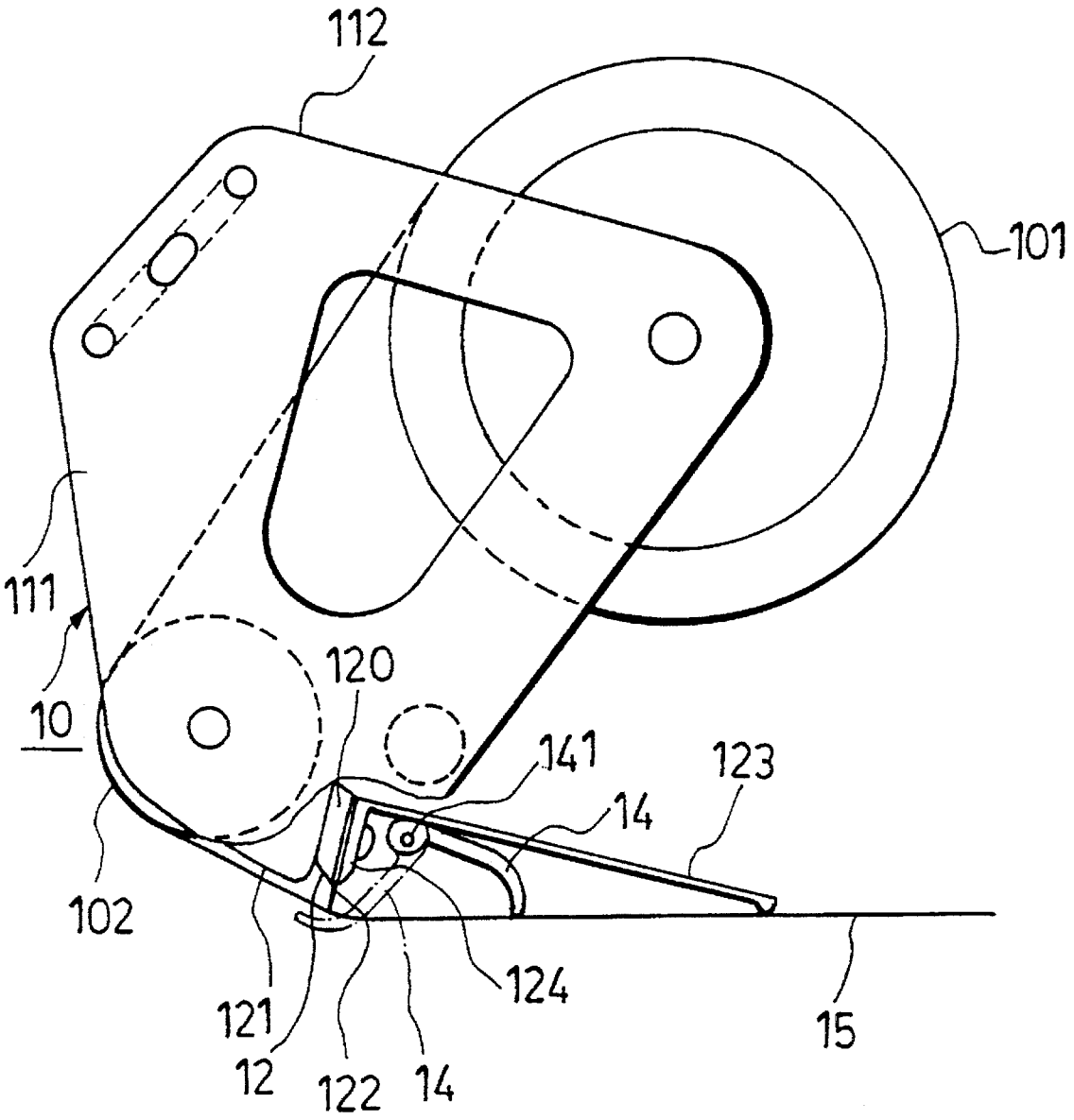
FIG.2 PRIOR ART
FIG. 2 is a side view of the conventional tape dispenser.
Figure 3:
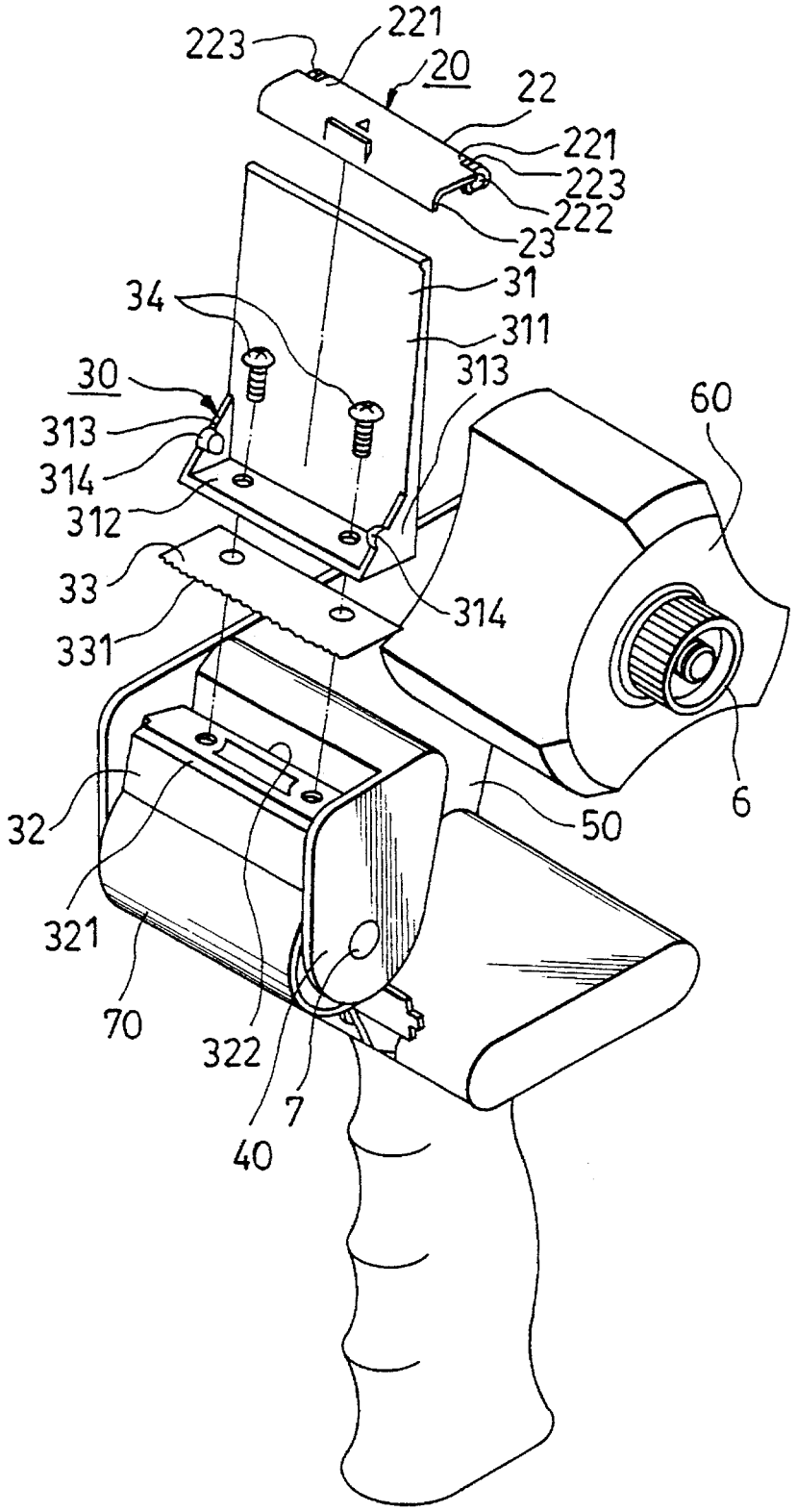
FIG. 3 is an exploded view of a tape dispenser of the present invention.
Figure 5:
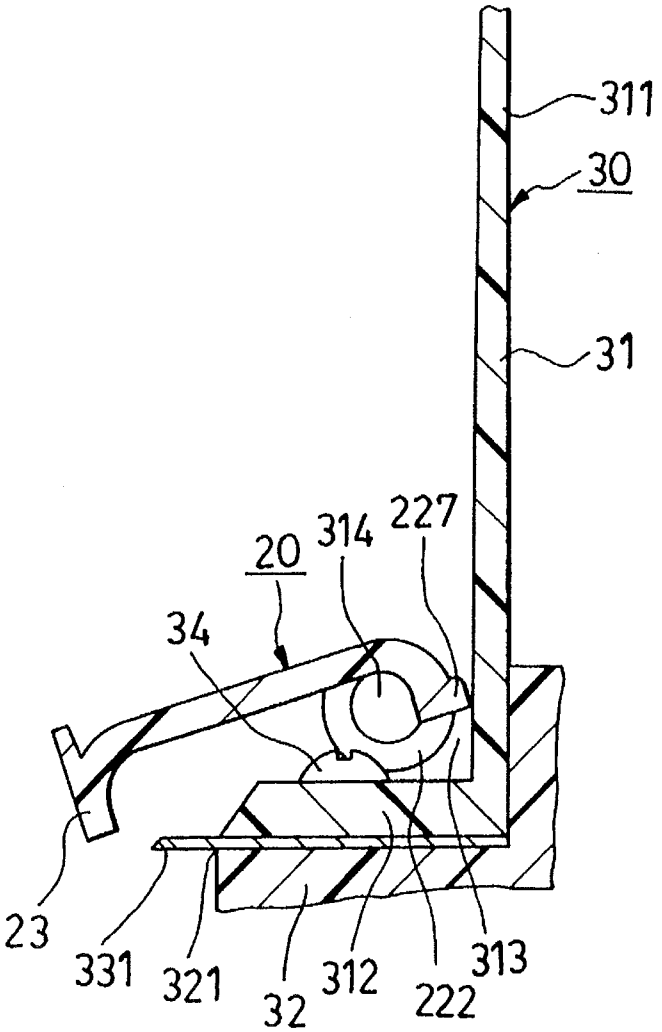
FIG. 5 illustrates the blade protecting shield when covering the cutting edge of the cutting device employed in the tape dispenser of the present invention.

Referring to FIGS. 3 and 5, an exploded perspective view of a preferred embodiment of a portable tape dispenser according to the present invention is shown. The tape dispenser includes a mounting frame member, a cutting device 30 and a blade protecting shield 20. The mounting frame member includes first and second mounting plates 40, 50. A tape storage station, in the form of a combination of shaft 6 and a tape-mounting roller 60, is fixed at one end portion of the first mounting plate 50, while a tape dispensing port, also in the form of a combination of a shaft 7 and a positioning roller 70, is mounted rotatably at another end portion of the first mounting plate 50.

The cutting device 30 includes a blade holding seat 32, a blade member 33, a smoothing unit 31 and a blade protecting shield 20. The blade holding seat 32 is mounted fixedly adjacent to the tape dispensing port for cutting a strip of tape from a tape end portion which is pulled out from the tape dispensing port along a tape dispensing route and has a front edge 321 and a rear edge 322 opposite to the front edge 321. The blade 33 has a front cutting edge 331 which is provided on the blade holding seat 32. The smoothing unit 31 includes a base plate 312 which is mounted above the blade holding seat 32 by means of screws 34 such that the base plate 312 sandwiches a rear portion of the blade 33 and permits the cutting edge 331 of the blade 33 to protrude exteriorly from between the base plate 312 and the blade holding seat 32. The smoothing unit 31 further has a smoothing plate 311 which extends from the rear periphery of the base plate 312, a pair of spaced connecting plates 313 formed between the base plate 312 and the smoothing plate 311 of the smoothing unit 31, and a pair of aligned pivot shafts 314 which extend respectively and inwardly from the connecting plates 313.

Figure 4:
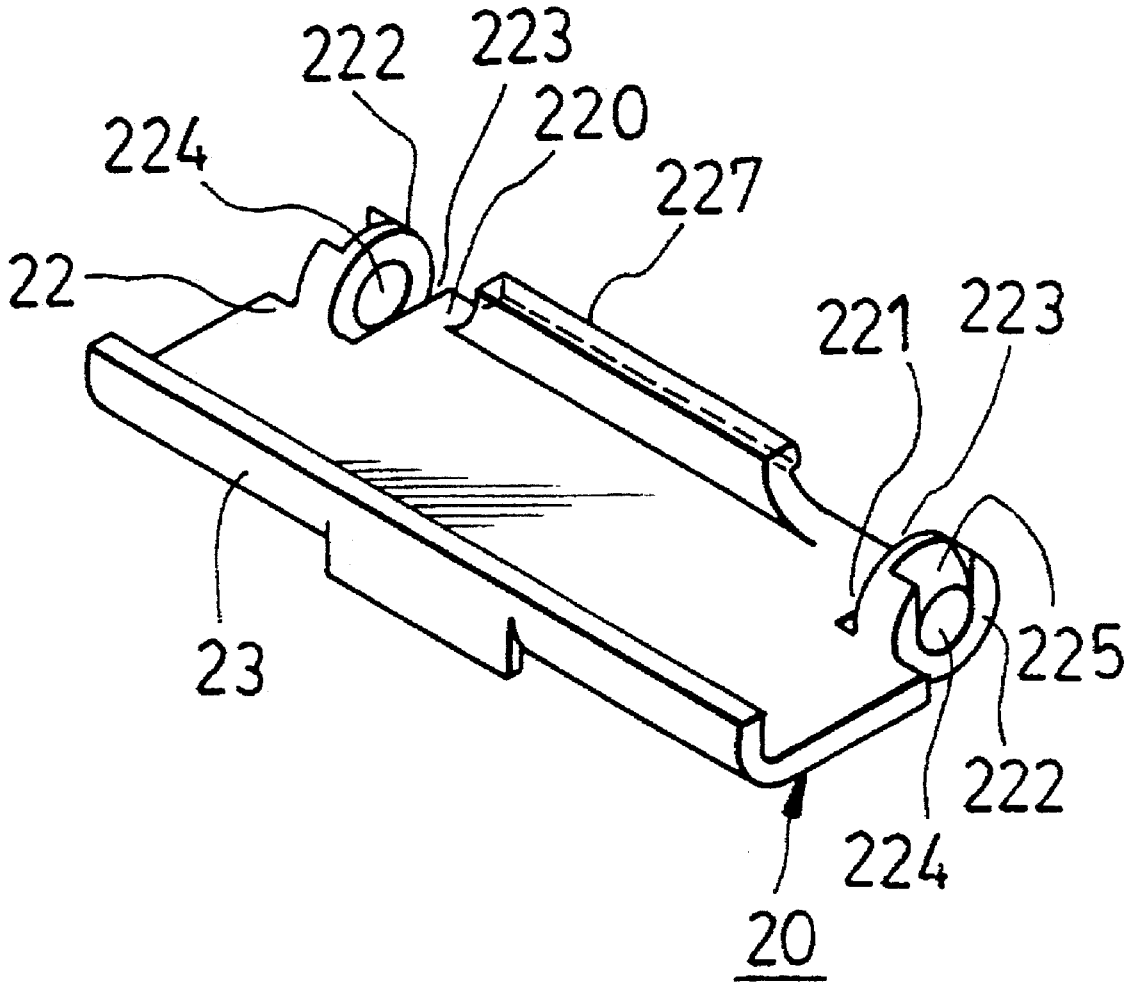
FIG. 4 illustrates a blade protecting shield employed in the tape dispenser shown in FIG. 3.

Referring to FIG. 4, the blade protecting shield 20 is substantially curved at an intermediate section and is made of a plastic material. The blade protecting shield 20 has a frontward edge 23, a rearward edge 22 opposite to the frontward edge 23, a projection 220 which extends integrally and rearwardly from the rearward edge 22, and a pair of spaced pivot blocks 222 which extend rearwardly from the rearward edge 22 and which are disposed respectively on two sides of the projection 220. The projection 220 has two opposed end portions 221, each of which forms a clearance 223 with the respective one of the pivot blocks 222. The projection 220 is provided with a downwardly and rearwardly extending portion 227, the purpose of which will be described in the following paragraphs. Each of the pivot blocks 222 has a recess 224 and an inclined face 225 exposed exteriorly thereof.

Figure 6:
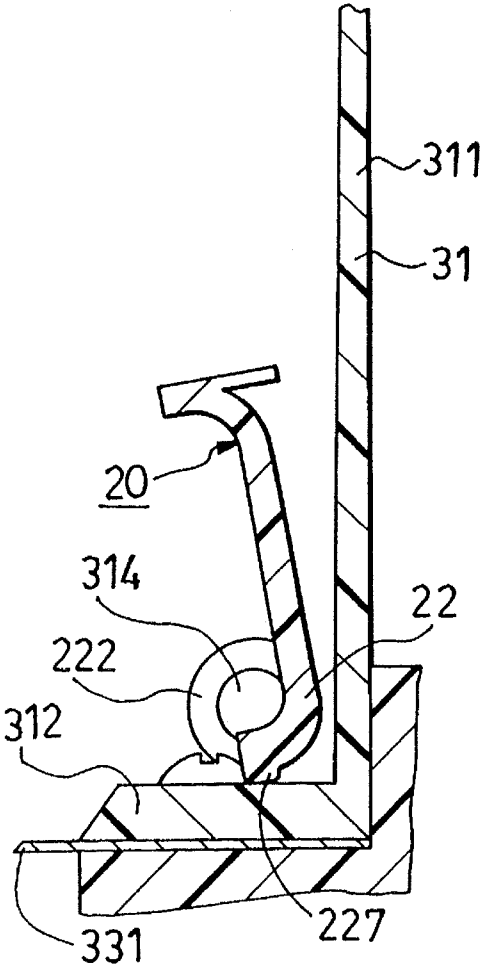
FIG. 6 illustrates the blade protecting shield when exposing the cutting edge of the cutting device employed in the tape dispenser of the present invention.

The pivot blocks 222 of the blade protecting shield 20 are placed on the pivot shafts 314 and are pressed downward such that the pivot shafts 314 slide past the inclined faces 225 and extend into the recesses 224 of the pivot blocks 222 of the blade protecting shield 20, thereby mounting the blade protecting shield 20 pivotally between the connecting plates 313 of the smoothing unit 31. Under this condition, the blade protecting shield 20 can pivot relative to the connecting plates 313 between a first position, wherein the downwardly and rearwardly extending portion 227 of the projection 220 of the blade protecting shield 20 engages frictionally the base plate 312 of the smoothing unit 31 while the front edge of the blade protecting shield 20 uncovers the cutting edge 331 of the blade 33, as shown in FIG. 6, and a second position, wherein the portion 227 of the projection 220 of the blade protecting shield 20 engages frictionally the smoothing plate 311 of the smoothing unit 31 while the front edge of the blade protecting shield 20 covers the cutting edge 331 of the blade 33, as shown in FIG. 5.

Note that even if the tape dispensing portion of the tape dispenser of the present invention is held upright so as to dispose the cutting device 30 at an upward position, the cutting edge 331 is still covered by the blade protecting shield 2 0 because the protecting shield 20 can be retained at the second position due to the frictional engagement between the portion 227 and the smoothing plate 331. Thus, the likelihood of being injured by the cutting edge 331 of the cutting device 30 employed in the tape dispenser is very small. When it is desired to cut out a strip of tape, a mere upward lift on the blade protecting shield 20 can dispose the same at the first position in order to expose the cutting edge 331 of the cutting device 30. A little force must be employed to press the cutting edge 331 of the cutting device 30 into the tape extending route of the packing tape.

Note that the clearance 223 between the pivot block 222 and the end portion 221 of the projection 220 facilitates sliding movement of a respective one of the pivot shafts 313 into a corresponding one of the recesses 224 when mounting the blade protecting shield 20 pivotally on the pivot shafts 313.

While the present invention has been described with what is considered to be the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A tape dispenser with a cutting device mounted adjacent to a tape dispensing port thereof for cutting a strip of tape from a tape end portion which is pulled out from said tape dispensing port along a tape dispensing route, said cutting device including a blade holding seat with a front edge and a rear edge opposite to said front edge, said blade holding seat being mounted fixedly adjacent to said tape dispensing port such that said front edge is nearby and transverse to said tape dispensing route and said rear edge is spaced from said dispensing route, a blade having a front portion with a cutting edge and said blade being provided on said blade holding seat such that said cutting edge protrudes out of said front edge of said blade holding seat so as to extend into said tape dispensing route, and a smoothing unit having a base plate with a rear periphery mounted above said blade holding seat to sandwich a rear portion of said blade therebetween, said smoothing unit permitting said cutting edge of said blade to protrude exteriorly from between said base plate and said blade holding seat, said smoothing unit further having a smoothing plate which extends from said rear periphery of said base plate, said cutting device further comprising:

a pair of spaced connecting plates formed between said base plate and said smoothing plate of said smoothing unit;

a pair of aligned pivot shafts extending respectively and inwardly from said connecting plates; and a blade protecting shield with a frontward edge, a rearward edge opposite to said frontward edge, a projection with two opposed end portions extending integrally and rearwardly from said rearward edge, and a pair of spaced pivot blocks extending rearwardly from said rearward edge and disposed respectively on two sides of said projection such that a clearance is formed between each of said pivot blocks and a respective one of said opposed end portions of said projection, each of said pivot blocks having a recess for receiving a respective one of said pivot shafts and said blade protecting shield being pivotable relative to said connecting plates between a first position, wherein said projection of said blade protecting shield engages frictionally said base plate of said smoothing unit while said front edge of said blade protecting shield uncovers said cutting edge of said blade, and a second position, wherein said projection of said blade protecting shield engages frictionally said smoothing plate of said smoothing unit while said front edge of said blade protecting shield covers said cutting edge of said blade.

2. The tape dispenser as defined in claim 1, wherein each of said pivot blocks further has an inclined face which facilitates sliding movement of a respective one of said pivot shafts into a corresponding one of said recesses when mounting said blade protecting shield pivotally on said pivot shafts.

3. The tape dispenser as defined in claim 1, wherein said projection of said blade protecting shield is further provided with a downwardly and then rearwardly extending portion.

* * * * *